United States Patent [19]

Bratkowski et al.

[11] Patent Number: 4,725,799

[45] Date of Patent: Feb. 16, 1988

[54] CIRCUIT BREAKER WITH REMOTE CONTROL

[75] Inventors: Walter V. Bratkowski, McKeesport; Stephen A. Mrenna, Brighton Township, Beaver County, both of Pa.

[73] Assignee: Westinghouse Electric Corp., Pittsburgh, Pa.

[21] Appl. No.: 913,879

[22] Filed: Sep. 30, 1986

[51] Int. Cl.[4] ..... H01H 75/00; H01H 77/00; H01H 83/00

[52] U.S. Cl. ..... 335/14; 335/6; 335/20; 335/16

[58] Field of Search ..... 335/14, 20, 6, 16, 9, 335/189, 190, 185, 191; 200/153

[56] References Cited

U.S. PATENT DOCUMENTS

| | | | |
|---|---|---|---|
| 4,001,743 | 1/1977 | Arnhold | 335/201 |
| 4,308,511 | 12/1981 | Borona | 335/14 |
| 4,636,760 | 1/1987 | Lee | 335/14 |

*Primary Examiner*—E. A. Goldberg
*Assistant Examiner*—Lincoln Donovan
*Attorney, Agent, or Firm*—L. P. Johns

[57] ABSTRACT

A circuit breaker for use in remote load energy management systems and characterized by an insulating housing including opposite side walls, end walls and edge walls with a circuit breaker structure contained therein; a manual operator including a handle extending through an edge wall for actuating the structure between open and closed circuit conditions; an electromagnetic within the housing and including an armature for opening the circuit which armature is movable in an axis substantially perpendicular to the edge walls.

7 Claims, 3 Drawing Figures

CIRCUIT BREAKER WITH REMOTE CONTROL

CROSS-REFERENCE TO RELATED APPLICATION

This application is related to the copending application Ser. No. 707,616, filed Mar. 4, 1985, entitled "Current Limiting Solenoid Operated Circuit Breaker", of Y. K. Chien, W. V. Bratkowski, and J. A. Wafer; and Ser. No. 707,632, filed Mar. 4, 1985, entitled "Remotely Controlled Solenoid Operated Circuit Breaker" of W. V. Bratkowski and J. A. Wafer, both assigned to the present assignee.

BACKGROUND OF THE INVENTION

1. Field of the Invention

This invention generally relates to circuit breakers useful for remote power control and energy management for residential, commercial, and industrial applications.

2. Description of the Prior Art

From 1970 to 1980 energy was a major concern in the United States and the cost of electric power rapidly increased and provided significant economic incentive to conserve energy. It was during this time that an energy crisis occurred. Although the energy crisis has now passed, energy will continue to be a critical factor in the economy. Electric utilities are becoming increasingly concerned with energy management and conservation. A forecast of supply, demand, and cost of electrical energy will increase during the next fifteen years by approximately a factor of two. If the current lifestyle is to be preserved, energy must be more efficiently used in the future for which reason energy management systems will play a vital role in this future.

Although breaker/switch devices for remote control are in use for commercial and industrial applications, the devices have involved solenoid operated mechanisms which are disposed along the bottom edge of a circuit breaker housing opposite the edge from which the manual handle extends for actuation of a contact carrying arm. The armatures of such solenoids have extended parallel to the longitudinal axis of the longer dimension of the circuit breaker. As a result, such circuit breakers have not been adaptive to insulation in standard circuit board panels used for existing residential application. In other words, a smaller circuit breaker having a remotely controlled solenoid for residential use has been necessary.

SUMMARY OF THE INVENTION

In accordance with this invention a circuit breaker for use in remote control is provided which comprises an insulating housing having electrical terminals thereon; separable contact means including a stationary contact and a movable contact disposed in the housing to form a circuit breaker path between the terminals; manual actuating means within the housing for operating the circuit breaker and including an operating lever and a release lever for opening and closing the movable contact member; the actuating means also including an assist lever operable on the movable contact and cooperable with the operating lever to close the contacts; first electromagnetic means having an armature for actuating the movable contact and energized by an electric pulse for opening or closing the circuit from a remote circuit; coupling means between the first electromagnetic means and the movable closing of the contacts by the first electromagnetic means when the manual actuating means is in a open-contact position; the movable contact comprising an overcenter toggle structure; the operating lever and the assist lever cooperating to move the toggle structure overcenter to the closed-contact position; the operating lever and the assist lever being disposed on opposite sides of the toggle structure; second electromagnetic means for actuating the movable contact to an open circuit position in response to the occurrence of a short circuit condition; the coupling means including a link and a connecting lever; the link extending between the movable contact and the connecting lever; the connecting lever extending between the armature and the link; one of the link and connecting lever having a pin-receiving slot extending substantially in the direction of movement of the link; and the other of the link and connecting lever having a pin extending into the slot, whereby operation of either of the manual operating means and the electromagnetic means is independent of the other.

The advantage of the device of this invention is that it provides for remote control and energy management within a circuit breaker housing which is adapted for installation in a conventional circuit breaker panel such as of the residential size, and which is compatible with both AC and DC control power from direct or solid state logic sources. The control signal can be a steady state or a pulsed operation.

Moreover, if control voltage stays on and a short circuit occurs, the circuit is opened either by a bimetal trip or a short circuit trip coil. These features are due to the design of the mechanism or electromagnetic trip. The contact will open and latch out, even though the coil is still energized. This is desirable because, if a short circuit occurs, the electromagnetic actuator or bimetal cannot act fast enough to clear the fault as quickly as necessary.

DESCRIPTION OF THE PREFERRED EMBODIMENT

Figure 1:
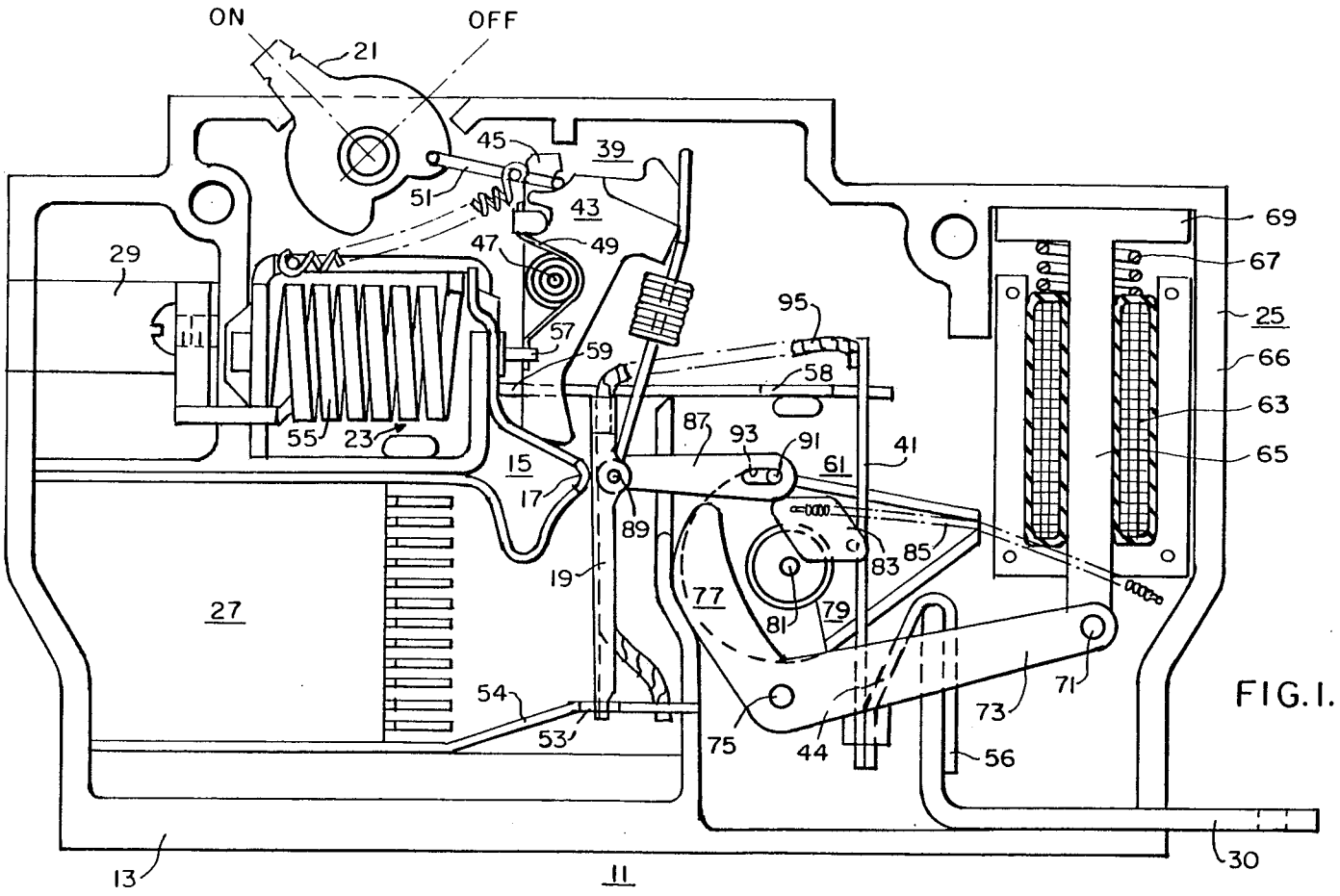
FIG. 1 is a vertical, sectional view through a circuit breaker with the contacts in the closed condition, taken on the line I—I of FIG. 3.

In FIG. 1, a molded breaker is generally indicated at 11 and it comprises a housing 13, and a circuit breaker structure 15 which includes a stationary contact 17 and movable contact 19, means for actuating the movable contact including a handle 21, a current-limiting electromagnetic mechanism or short circuit trip device 23, an electromagnetic means or solenoid 25, and a bimetal strip 41. The circuit breaker 11 also comprises an arc-quenching device 27, a line terminal 29, and a load terminal 30.

Figure 3:
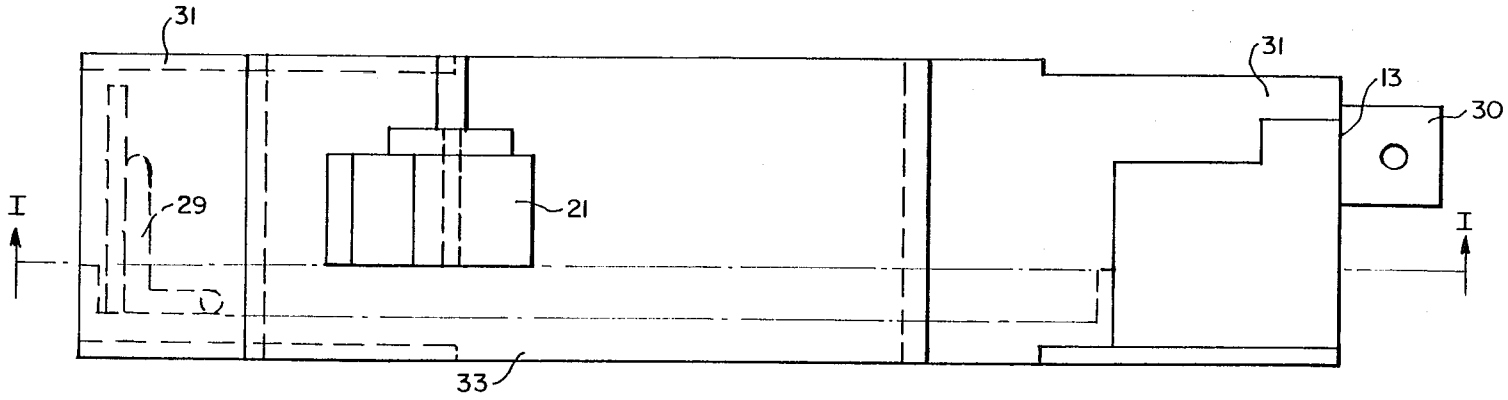
FIG. 3 is a plan view of the circuit breakers of FIGS. 1 and 2.

The housing 13 comprises a body 31 and a detachable cover 33 (FIG. 3), both of which are comprised of an electrically-insulating material, such as an epoxy resin or thermal plastic material.

The circuit breaker structure 15 is mounted within the chamber of the housing 13 and comprises an unlatching mechanism 39. In addition, the circuit breaker 11 comprises four mechanisms for opening the contacts 17, 19 which mechanisms include the manual handle 21, the current limiting electromagnetic device or short circuit device 23, the bimetal strip 41, and the electromagnetic structure 25. The unlatching mechanism 39 includes an operating or kicking lever 43 and a releasing lever 45, both of which are pivotally mounted on a pivot pin 47. The releasing lever 45 fits over a recess of the operating lever 43 where it is retained in place by a bias spring 49. A wire bail 51 extends from the handle 21 to the upper end of the releasing lever 45. The unlatching mechanism 39 functions in a manner set forth more particularly in U.S. Pat. No. 4,001,743 which is incorporated herein by reference. Suffice it to say, when the handle 21 is rotated from the ON to the OFF position, the kicking and releasing levers 43, 45 rotate against the movable contact 19 to move it away from the stationary contact 17. For that purpose, the lower end of the movable contact is pivotally mounted in a hole 53 in an arc guide rail 54.

When a current overload occurs, such as six or more times the rated current, the short circuit device 23, which includes a coil 55 and an armature 57, is actuated to rotate the kicking lever 43 counterclockwise to move the movable contact 19 away from the stationary contact 17 and thereby open the circuit.

When there is a slow increase in the rated current, the bimetal strip 41 heats up and rotates clockwise about its mounting 44 at the lower end of the strip where it is mounted on a terminal conductor 56. As the bimetal strip 41 rotates clockwise, it moves an armature 57 to the right, whereby a hook 59 at the left end of the link 58 rotates the lower end of the kicking lever 43 against the upper end of the movable lever 19, thereby opening the circuit. Whereas, the bimetal strip 41 operates in response to a slow increase in the rated current and thereby heats up over a given time period, the short circuit device 23 responds more quickly to a large overload.

The electromagnetic coil 25 functions with a bistable toggle mechanism 61 to open and close the contacts 17, 19. The electromagnetic structure 25 includes a coil 63, an armature 65, and a coil spring 67. The spring is disposed between the coil and a flanged end 69. The lower end of the armature 65 is pivotally connected at 71 to a lever or bellcrank 73 which is pivotally supported at 75. The lever 73 includes a propeller 77 for actuating the bistable toggle mechanism 61 between positions corresponding to open and closed conditions of the contacts 17, 19. Inasmuch as the construction and operation of the bistable toggle device is set forth in copending application Ser. No. 707,632, filed Mar. 4, 1985 entitled "Remotely Controlled Solenoid Operating Circuit Breaker", of J. A. Wafer and W. V. Bratkowski, only a limited description is set forth herein. The bistable mechanism includes lever 79, mounted on a pin 81, a flipper 83, and a toggle spring 85. The bistable toggle mechanism 61 is rotated about the pivot pin 81 to move the movable contact between open and closed positions of the stationary contact 17. For that purpose a link 87 is pivotally mounted between the movable contact 19 on a pin 89. A pin 91 on the upper side of the lever 79 extends through a slot 93 on the right end portion of the link 87.

When the contacts 17, 19 are closed, a circuit through the circuit breaker 11 extends from the line terminal 29, the coil 55, the stationary contact 17, movable contact 19, a shunt 95, the bimetal strip 41, the connector 44, the terminal conductor 56, to the load terminal 30.

The electromagnetic structure 25 is actuated by a pulse of current for moving the movable contact between open and closed positions of the contacts 19. For that purpose, to open the contacts a pulse of current is applied to the coil 63, whereby the flanged end 69 of the armature is pulled toward the upper end of the core 66 to thereby rotate the lever 73 clockwise about the pivot 75. The propeller 77 moves against the flipper 83 to rotate the lever 79 clockwise about the pivot pin 81 from the position shown (FIG. 1), thereby pulling the link 87 to the right to separate the contacts. When that action occurs, none of the other operating parts including the handle 21, the short circuit device 23, or the unlatching mechanism 39 operates. After the current pulse occurs, the spring 67 raises the armature 65 to the upper position (FIG. 1), whereby the pin 91 travels through the slot 93 to the opposite end thereof, without moving the link.

Subsequently, when a pulse of current is applied to the electromagnetic structure 25, the propeller 77, acting against the flipper 83, rotates the lever 73 in the counterclockwise direction, thereby moving the movable contact 19 to the closed position via the link 87. Once again, the spring 67 raises the armature to the position shown and the lever 79 returns to the position shown with the pin 91 in the right end portion of the slot 93.

It is noted that the slot 93 extends in a direction of movement of the link 87. Accordingly, when one of the other contact moving structures, such as the handle 21, the short circuit device 23, or the bimetal strip 41, acts to move the movable contact 19 to the open contact position, the position of the bistable toggle mechanism 61 is undisturbed, because the slot 93 travels over the pin 91. In other words, the slot 93 provides the circuit breaker 11 with a trip-free function, that is, if the handle 21 is locked in the ON position, the circuit breaker can perform its normal interruption functions including remote control, bimetal trip, and overload or short circuit tripping.

Figure 2:
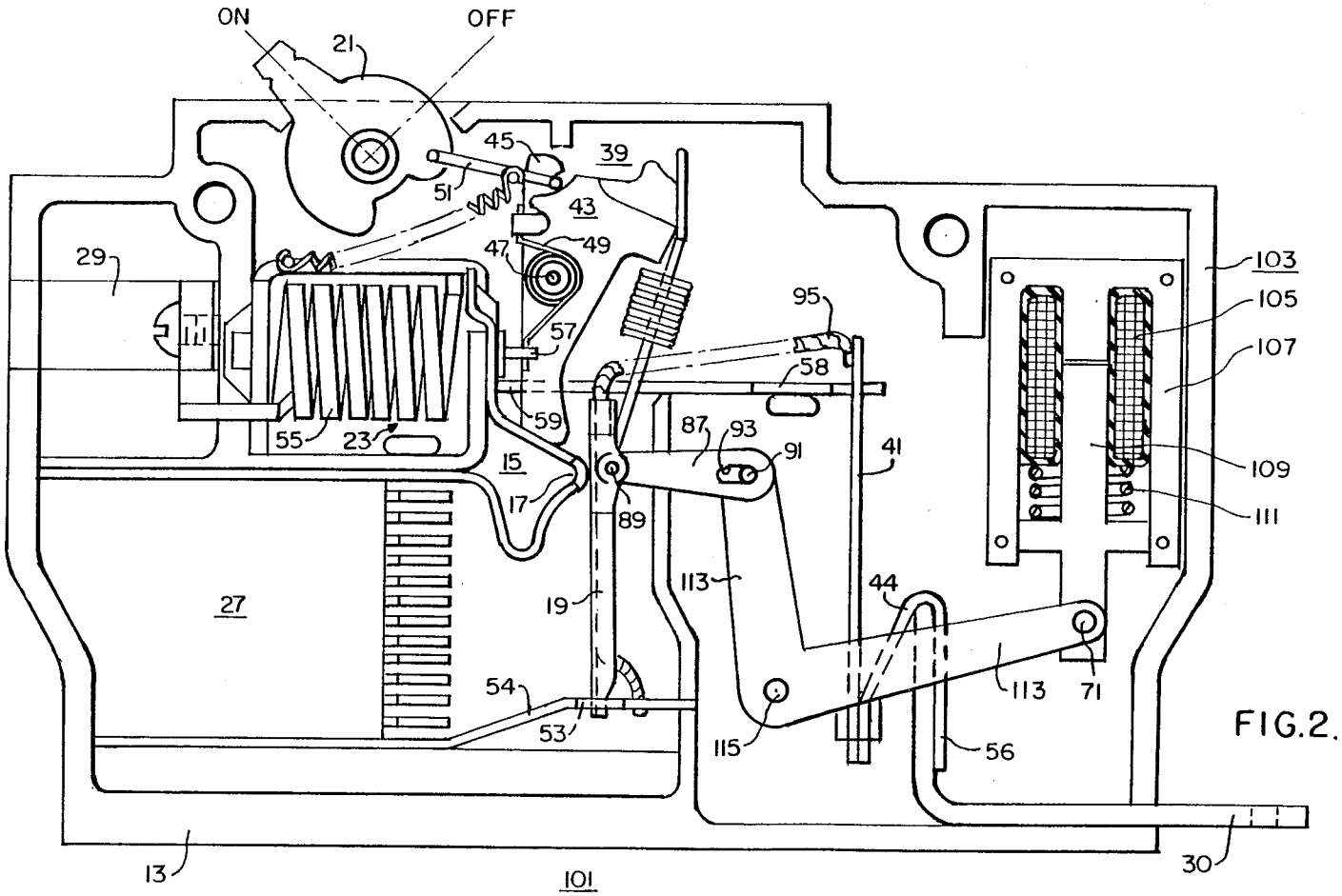
FIG. 2 is another embodiment of the circuit breaker of FIG. 1.

In FIG. 2 another embodiment of a circuit breaker 101 is shown in which an electromagnetic device 103 is provided which differs from that of the electromagnetic structure 25. In both embodiments of the circuit breakers 11 and 101, similar numerals refer to similar parts. The electromagnetic device 103 comprises a coil 105, a core 107, an armature 109, and a coil spring 111. The lower end of the armature 109 is connected by a pin 71 to a lever or bellcrank 113 which is pivotally mounted at 115. The upper end of the bellcrank 113 includes a pin 91 which is disposed in the slot 93 of the link 87. In the position of the electromagnetic device 103, the coil 105 is energized so that the upper end of the armature is disposed against the central core and the spring 111 is compressed. In this position, the pin 91 is disposed in the right end of the slot 93 and the contacts 17, 19 are closed. So long as the core 105 is energized, the movable contact is free to move between open and closed positions in response to actuation by either the handle 21, the coil 55, or the bimetal strip 41. The foregoing is true due to the location of the pin 91 within the slot 93.

When, however, the coil 105 is de-energized, the coil spring 111 moves the armature 109 downwardly to rotate the bellcrank 113 clockwise about the pivot 115 and to cause the pin 91 to move the link 87 to the right and thereby open the contacts 17, 19. So long as the coil 105 is de-energized, it is impossible for the contact 19 to be moved to the closed position with the contact 17, such as by the handle 21, the coil 55, or the bimetal strip 41.

Accordingly, when the coil 105 is energized, the contacts are closed. Conversely, when the coil 105 is de-energized, the contacts are open. On the other hand, due to the provision of the bistable toggle mechanism 61 (FIG. 1), the electromagnetic structure 25 is pulse-operated, that is, a pulse of current to the coil 63 moves the bistable toggle mechanism 61 to a position corresponding to the open contact position. However, a subsequent pulse of current through the coil 63 actuates the bistable toggle mechanism 61 to the alternate position of the contacts 17, 19.

In conclusion, the circuit breakers of this invention provide a current limiting solenoid operated means for an energy management system by an electric pulse or a continuing current operation. Moreover, the device of this invention performs the function of a circuit breaker as well as a remotely controlled switch and is compatible with both AC and DC control power from direct or solid-state logic sources. The control signal can be either steady state or a pulsed operation.

What is claimed is:

1. A circuit breaker for use in remote load energy management systems, comprising:

(a) an electrically insulating housing including line and load terminals;

(b) separable contact means including a stationary contact and a movable contact arm within the housing forming a circuit breaker path between the terminals;

(c) manual operating means, operably attached to the movable contact arm, within the housing for actuating the contacts between open and closed positions;

(d) first electromagnetic means within the housing for actuating the movable contact and including an electromagnet and an armature for opening or closing the movable contact and energizable by an electric current from a source remote from the circuit breaker;

(e) the electromagnetic means including biasing means for retracting the armature from the electromagnet when the electromagnetic means is deenergized;

(f) coupling means coupling the armature to the movable contact and including a link said link being jointly pivoted with the manual operating means on the movable contact arm;

(g) the coupling means also comprising a lever extending between the armature and the link;

(h) the lever being operatively connected between the armature and the link; and (i) one of the link and lever having a pin-receiving slot extending in the direction of movement of the link and the other of the link and lever having a pin extending into the slot, whereby operation of either of the manual operating means and the electromagnetic means is independent of the other and whereby inertia and friction for opening and closing the contacts is minimal.

2. The circuit breaker of claim 1 in which the movable contact comprises an overcenter toggle structure.

3. The circuit breaker of claim 1 in which second electromagnetic means are disposed within the housing for actuating the movable contact to an open circuit position in response to the occurrence of a short circuit condition.

4. The circuit breaker of claim 3 in which the manual actuating means includes an operating lever and a releasing lever for opening and closing the movable contact.

5. The circuit breaker of claim 4 in which manual operating means also includes an assist lever operable on the movable contact and cooperable with the operating lever to close the contacts.

6. The circuit breaker of claim 5 in which the coupling means includes a bistable toggle mechanism actuated by the second electromagnetic means when energized by an electric pulse for opening or closing the circuit from a remote circuit.

7. The circuit breaker of claim 1 in which the link includes the pin-receiving slot.

* * * * *